US005457856A

United States Patent [19]

Murasaki

[11] Patent Number: 5,457,856

[45] Date of Patent: Oct. 17, 1995

[54] INTEGRALLY MOLDED SURFACE FASTENER

[75] Inventor: Ryuichi Murasaki, Toyama, Japan

[73] Assignee: Yoshida Kogyo K.K., Tokyo, Japan

[21] Appl. No.: 77,436

[22] Filed: Jun. 17, 1993

[30] Foreign Application Priority Data

Jun. 17, 1992 [JP] Japan ..... 4-041556 U

[51] Int. Cl.[6] ..... A44B 18/00

[52] U.S. Cl. ..... 24/452

[58] Field of Search ..... 24/442, 444, 445, 24/447, 452, 575

[56] References Cited

U.S. PATENT DOCUMENTS

| | | | |
|---|---|---|---|
| 3,266,113 | 8/1966 | Flanagan, Jr. | 24/452 |
| 4,984,339 | 1/1991 | Provost et al. . | |
| 5,040,275 | 8/1991 | Eckhardt et al. | 24/442 X |

FOREIGN PATENT DOCUMENTS

| | | |
|---|---|---|
| 0325528A1 | 7/1989 | European Pat. Off. . |
| 0421295A1 | 4/1991 | European Pat. Off. . |
| 0464753A1 | 1/1992 | European Pat. Off. . |
| 464754 | 1/1992 | European Pat. Off. . |

*Primary Examiner*—James R. Brittain

*Attorney, Agent, or Firm*—Hill, Steadman & Simpson

[57] ABSTRACT

An integrally molded surface fastener which promotes high manufacturing efficiency, assures easy stock control and easy attachment in the shipment, and provides high engaging strength and stable form without deterioration of engaging and holding force even when used repeatedly. The surface fastener has a pair of upper (male) and lower (female) engaging members of the same structures, which are molded integrally and provided with a plurality of rows of hook elements on the surfaces of engaging base plates. Then, this arrangement unit has successively two hook elements of predetermined pitches and a spacing of two pitches length and is repeated in order continuously. The spacing signifies that one hook element is not present. Due to the spacings, a hook element of one engaging member is inserted between two hook elements of the other mating engaging member, and respective two hook elements are easily elastic-deformed in the separating direction to provide reliable engagement of the opposed two hook elements even if positions of the opposed hook elements do not match perfectly.

3 Claims, 5 Drawing Sheets

INTEGRALLY MOLDED SURFACE FASTENER

BACKGROUND OF THE INVENTION

1. Field of the Invention

This invention relates to a surface fastener molded integrally of synthetic resin comprising a pair of upper and lower engaging members in which a plurality of rows of hook elements are integrally molded of synthetic resin on surfaces of respective engaging base plates and which adopt the same structures to facilitate the manufacture and the control of products and to assure uniform distribution of engaging strength and durability.

2. Description of Prior Art

The usual surface fastener is known as a so-called velvet type fastener comprising a pair of male and female tapes, wherein an engaging element of male tape is formed as hook-like pojection by cutting a part of a loop in the fastener made of knitted cloth, or an engaging element of male tape is formed as a hook-like, mushroom-like, anchor-like projection in the fastener molded integrally of synthetic resin, and an engaging element of female tape is mainly formed of a loop of a loop knitted cloth.

As stated above, the other engaging element or female element is formed of the loop of the loop knitted cloth to provide high engaging ability; however, the female element has weaker strength and is too flexibile. As a result, the female element has not been used as the industrial material since it does not meet the demand of positioning function and the durability.

The conventional surface fasteners made of synthetic resin are disclosed for examples in U.S. Pat. No. 2,499,898, Japanese Utility Model Unexamined Publication No. S 52-71808, and No. H 2-127205. Each of these surface fasteners comprises a pair of upper and lower (or male and female) engaging members which are respectively molded integrally of synthetic resin, so that these fasteners provide excellent positioning function and high strength of engaging elements in comparison with using female members of loop knitted clothes.

However, the above-mentioned surface fasteners comprise male and female engaging elements of mainly mushroom-shape. When the engaging element has a mushroom shape, the construction of the engaging element provides engaging strength weaker than that of the engaging element of hook-shape. When engaging and disengaging of the male and female elements are repeated, the engaging strength falls off in a short time, so that the fastener will be hardly usable.

A precedent surface fastener comprising a pair of male and female engaging elements of the same hook shape is proposed to solve the above-mentioned problems of the conventional surface fastener (Japanese Utility Application No. H 4-27364). This surface fastener is composed first and second engaging members which are respectively provided with a plurality of rows of hook elements. The hook elements of first and second engaging members are oriented in mutually opposite directions, and the pitch of hook elements on the first engaging member is set at twice as much as the pitch of hook elements of the second engaging member.

In order to engage hook elements of a first engaging member surely with hook elements of a second engaging member, it is required to guide and engage a hook element of the first engaging member between a pair of hook elements of the second engaging member in the row direction. During this guiding, hook elements of the first engaging member should be elastic-deformed separating mutually. In order to allow the elastic deformation in the mutually separating direction, it is considered to increase the pitch between hooks on both the first and second engaging members, however the density of the hook elements becomes rough so that the engaging strength deteriorates inevitably. The above-mentioned prior surface fastener is developed on general investigation of the above-mentioned problems. Since hook elements are engaged with each other to provide remarkably high engaging strength and stable form and to prevent its strength from decreasing in repeated engagement, the surface fastener can be used as suitable industrial materials.

The above-mentioned integrally molded surface fastener of this construction has the above-mentioned excellent qualities. But on the further investigation of this construction, it is found to be unsatisfactory.

That is, this surface fastener is composed of first and second engaging members of different constructions, so that it is required to form respective engaging members independently in manufacturing of the surface fastener. It is moreover required to classify first and second engaging members completely for the stock control of products and to confirm the combination and the number of combined first and second engaging members in ordering and receiving the order of products.

Further, since it is required to confirm that one is the first engaging member and the other is the second engaging member to attach both products, attaching work will be rather complicated.

SUMMARY OF THE INVENTION

It is therefore, an object of this invention to provide a novel surface fastener comprising a pair of engaging members which are respectively integrally molded together with hook elements of the same structures to assure high engaging strength and sufficient durability to be used repeatedly, to promote making efficiency, and to provide easy controlling and attaching works in the stock and shipment.

In order to accomplish the above-mentioned object, the surface fastener of this invention comprises a pair of upper (male) and lower (female) engaging members, in which a plurality of rows of hook elements are molded integrally with engaging base plates. The hook element is composed of a raised portion SP having a back face ba extending with a gentle slope from the surface of the engaging base plate and a front face fr extending straight from the engaging base plate, and a hook-like engaging portion FP extending forwardly from the end of the raised portion SP wherein the sectional area of the hook element is gradually increased from the end of the hook-like engaging portion FP to the root rt of the raised portion SP. Every row of hook elements of each engaging member is arranged to have a plurality of desired unit including two hook elements and a spacing without a hook element in order. The desired unit is repeated in every row to provide a desired hook element arrangement on each engaging member. Then, adjacent hook elements are mutually shifted by a predetermined pitch, and preferably, adjacent rows of hook elements of each engaging member are oriented in the mutually opposite directions.

Hook elements on upper and lower engaging base plates are formed as wavy shapes on the beach and are arranged oppositely as shown in FIGS. 1(*a* ), 1(*b*) and FIG. 2. In engagement of fastener, two hook elements of the upper engaging member confront opposing two hook elements of the lower engaging member as being shifted by one pitch. One hook element is pressed onto mating two hook elements while the tip face of the hook-like engaging portion FP of one hook element is contacted with the tip face of the hook-like engaging portion FP of one of the mating two hook elements and with the back face ba of the other mating hook element adjacent in row direction, to open these mating hook elements and is smoothly guided between the mating hook elements and engaged since the spacings are arranged between respective sets of two hook elements to allow easy elastic deformation of the hook elements. And the mating hook elements are deformed in the same way, so that the confronting hook elements of both engaging members are engaged more surely.

Accordingly, all hook elements of the upper and lower engaging members are mutually engaged uniformly and smoothly to assure desired engaging strength without being rough or rugged when engaged.

To disengage the engaged surface fastener, a disengaging force beyond a locking force of mating engaging members is applied to the engaged surface fastener, so that the tip ends of the engaged hook-like engaging portion FP are twisted slightly sideward and simultaneously opened in the mutually separating direction to provide easy disengagement.

Further objects and advantages of the invention will be apparent from the detailed description hereinbelow set forth, together with the accompanying drawings.

DETAILED DESCRIPTION OF THE PRESENTLY PREFERRED EMBODIMENTS

Figure 1A:
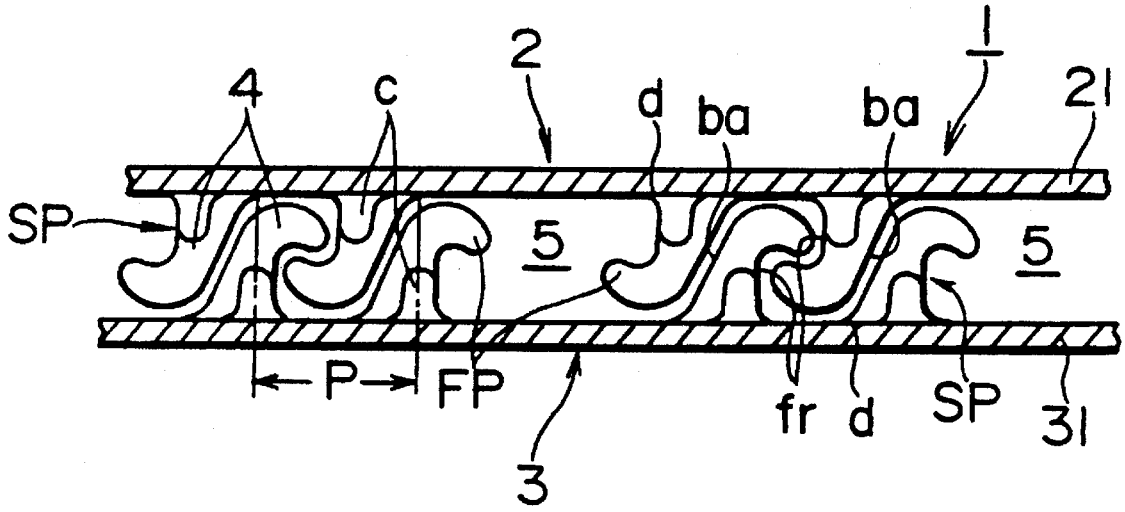
FIGS. 1(*a*) and 1(*b*) are illustrative views showing an engaging principle of an integrally molded surface fastener according to this invention.

Firstly, the engaging principle of the surface fastener of this invention will be illustrated with reference to FIGS. 1(*a*) and 1(*b*).

As stated above, a first feature of this invention is that upper and lower engaging members 2, 3 of the surface fastener 1 have the same structure.

A second feature of this invention is that a hook element of specific shape is adopted as an engaging element. The shape of the hook element comprises, as well as the precedent proposed hook shape, a raised portion SP having a back face ba extending with a gentle slope from flat base plates 21, 31 and a vertically standing front face fr, a hook-like engaging portion FP extending forwardly from the end of the raised portion SP, and ribs c formed on the both sides of the raised portion SP. Each hook element 4 has a sectional area which increases gradually from the tip end of the hook-like engaging portion FP to the root d of the raised portion SP. Accordingly, in this embodiment, the hook element 4 has the maximum area at the root d thereof. However, the area may be the same from the tip end of the hook-like engaging portion FP to the root d of the raised portion SP, or the front face fr may be formed to have an arcuate shape, so that this invention has various modification. And, the rib c is not an essential component of this invention.

A third feature of this invention is that two hook elements 4, 4 with a predetermined pitch and a spacing 5 which occupies the length of two pitches and wherein a hook element 4 is not disposed, are successively arranged in a row on a base plate, and this unit arrangement is successively repeated in the longitudinal direction.

The first feature is to form upper (male) and lower (female) engaging members as the same structure in the manufacture of a surface fastener molded integrally so as to provide easy forwarding and stocking work and so as to assure easy attachment of the surface fastener.

The second feature is further to assure easy molding, reliable engaging and disengaging, and sufficient durability for repeated use.

Figure 1B:
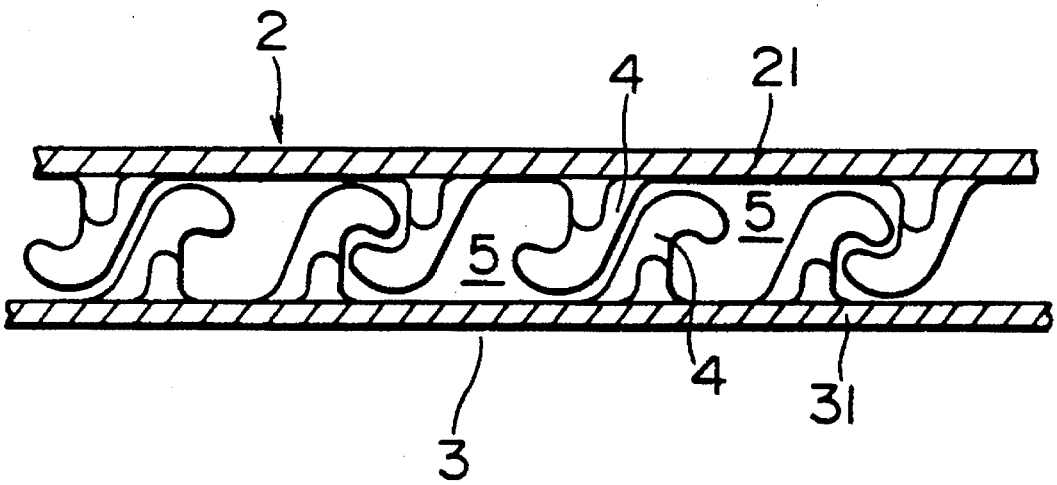
Figure 2:
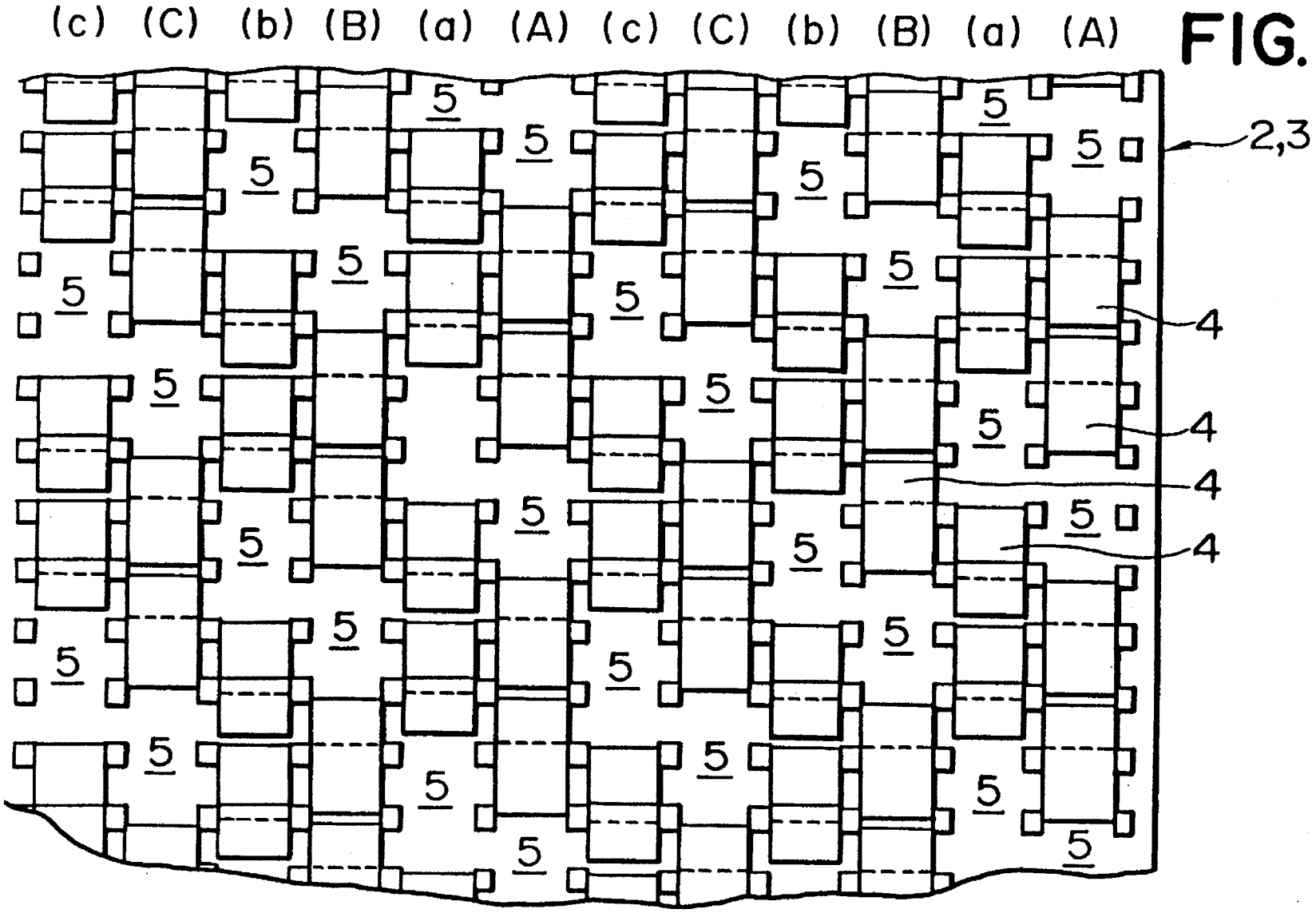
FIG. 2 is a plan view showing an arrangement of the integrally molded surface fastener of a first embodiment of this invention.
Figure 3A:
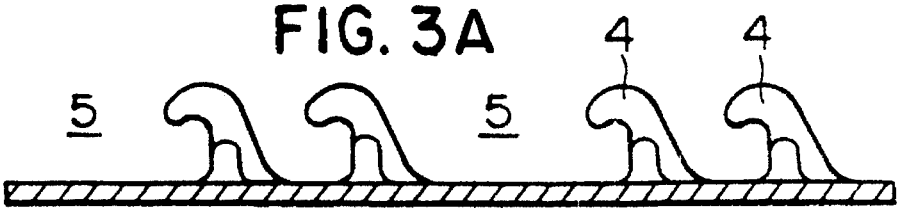
FIGS. 3A, 3B, 3C, 3D, 3E and 3F are side views showing every row of engaging elements of the surface fastener.
Figure 3B:
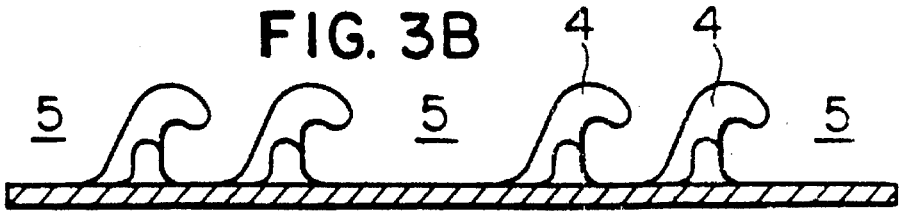
Figure 3C:
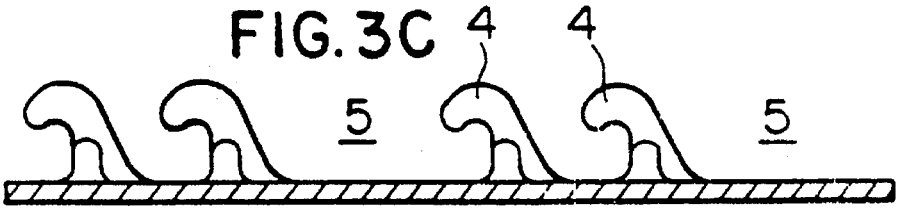
Figure 3D:
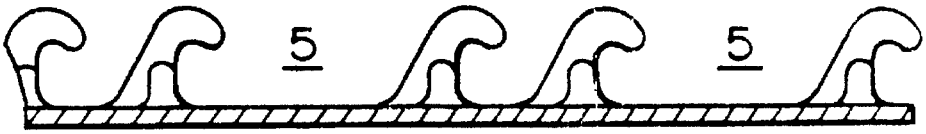
Figure 3E:
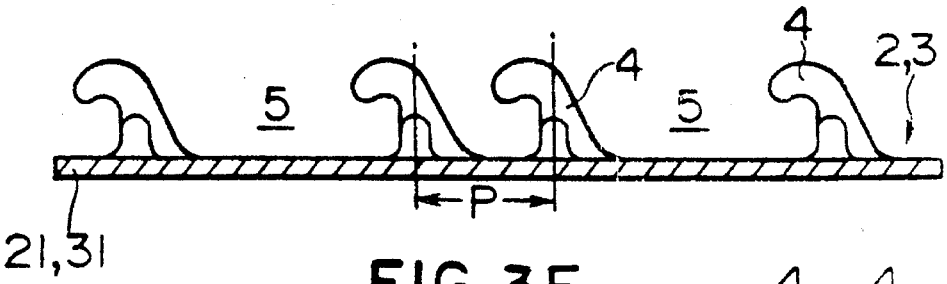
Figure 3F:
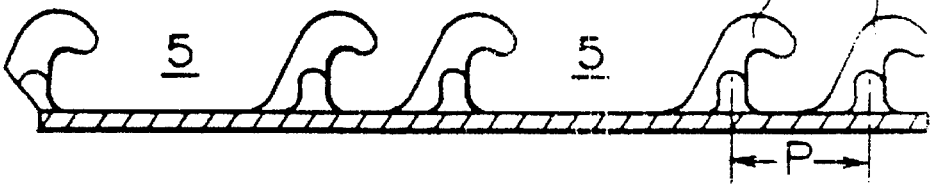

The third feature is furthermore to provide reliable engaging of opposed upper and lower hook elements 4 by disposing spacing 5 which makes respective two hook elements 4, 4 to be easily elastic-deformed in the separatable direction even if the positions of the opposed hook elements 4 do not mutually match in the row direction as shown in FIGS. 1(*a*) and (*b*) when the hook element 4 of the one engaging member is inserted into between the two hook elements of the opposite engaging member.

This invention is characterized by the above-mentioned three features, however, further aspect of this invention is now described.

The adjacent rows of hook elements which are arranged on respective surfaces of engaging base plate 21, 31, are oriented in the mutually reverse directions, whereby being prevented from having orientation in engaging strength in the row direction.

A surface fastener 1 of this invention is an integrally molded article of synthetic resin materials. As shown in both of the FIGS. 1(*a*) and 1(*b*), the upper and lower engaging members 2 and 3 have the same structure respectively. A plurality of rows of the hook elements 4 are linearly arranged and protruded on the surfaces of the engaging base plates 21, 31 at the above-mentioned regular arrangement.

According to the first embodiment shown in FIG. 2 and FIGS. 3A, 3B, 3C, 3D, 3E and 3F, the hook elements 4 are repeatedly arranged by the same patterns of every six rows as illustrated in FIGS. 3A, 3B, 3C, 3D, 3E and 3F. Three rows illustrated in FIGS. 3B, 3D and 3F of hook elements 4 are oriented in the same direction, and another three rows illustrated in FIGS. 3A, 3C and 3E of hook elements 4 are oriented in the reverse direction relative to the rows illustrated in FIGS. 3B, 3D and 3F of hook elements 4. Of cource, every row of hook elements 4 are repeatedly arranged in order at the above-mentioned unit arrangement including two hook elements 4 of predetermined hook pitch and a spacing 5 of two hook pitches. Every one pair of adjoining rows, such as rows illustrated in FIGS. 3A and 3B of hook elements 4 are respectively shifted by one second (½) of one hook pitch, and adjoining pair of rows such as rows illustrated in FIGS. 3E and 3B of hook elements 4 are arranged at positions shifted by three seconds (3/2) of one hook pitch in the same direction.

When one of two engaging members having the same structure is rotated by 180 degrees in the same plane and the surfaces having projected hook elements 4 are pressed toward each other, the hook elements 4 of the two engaging members are mutually engaged as follows.

When hook elements 4 having vertical cross sections of wavy shapes on the beach are arranged as mentioned above on upper and lower engaging base plates 21, 31, the hook elements 4 of the upper and lower engaging members 2 and 3 are engaged in face-to-face relation as shown in FIGS. 1(*a*), 1(*b*) and 2. During engagement, a set of two hook elements 4, 4 of the upper engaging member 2 are shifted by one pitch relative to a set of two hook elements 4, 4 of the lower engaging member 3. While the tip face of the hook-like engaging portion FP of one hook element 4 is contacted with the tip face of the hook-like engaging portion FP of the one of the mating hook elements 4, 4 and with the back face ba of the other mating hook element 4 adjoined in the same row, the one hook element is pressed and is guided smoothly between the adjacent mating hook elements 4, 4 due to the spacing 5 to provide reliable engagement between the upper and lower engaging members.

Thus, the hook elements of the whole hook surfaces of the upper and lower engaging members 2, 3 are uniformly and smoothly engaged to assure desired engaging strength without being rough.

In case of disengaging the engaged surface fastener 1, when a force stronger than the engaging force between both engaging members 2 and 3 is applied to both engaging members 2 and 3 in the separating direction, the tip ends of the engaged hook-like engaging portions FP are twisted slightly sideward add simultaneously opened in the separating direction to provide easy disengagement.

Figure 4:
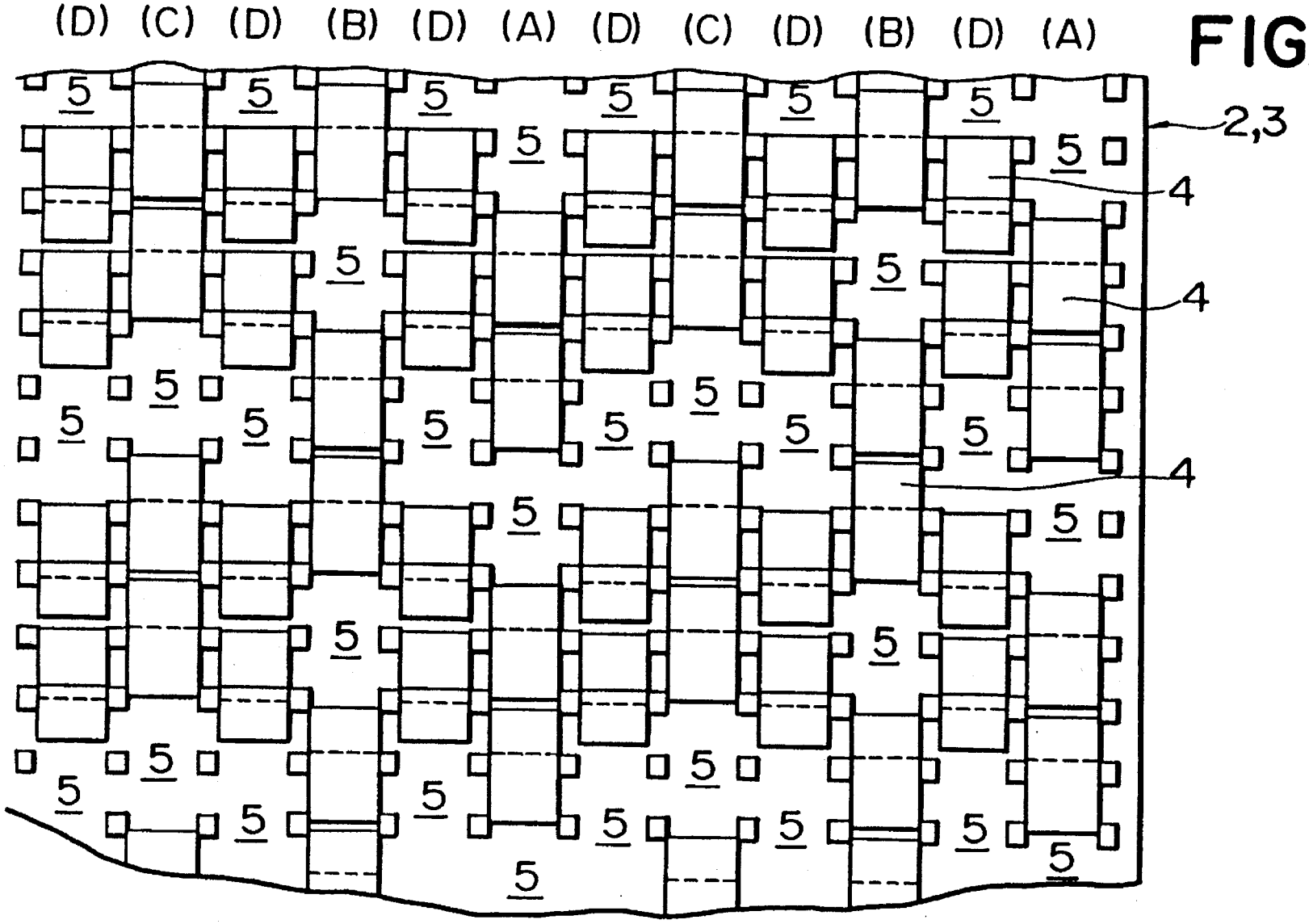
FIG. 4 is a plan view showing another arrangement of the integrally molded surface fastener of a second embodiment of this invention.
Figure 5A:
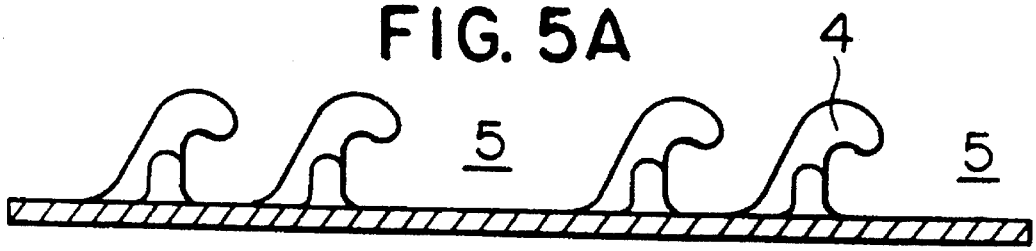
FIGS. 5(A), 5(B), 5(C) and 5(D) are side views showing every row of engaging elements of the surface fastener of the second embodiment.
Figure 5B:
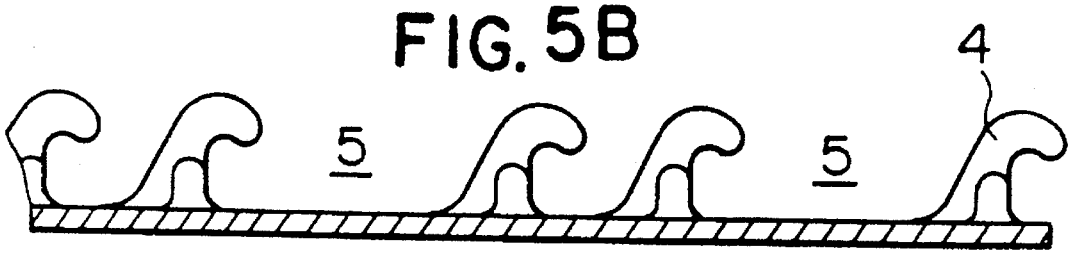
Figure 5C:
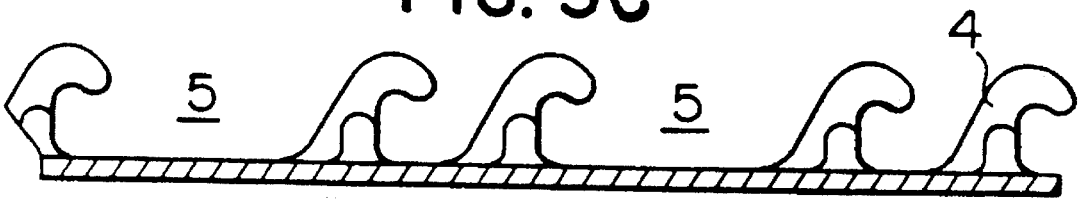
Figure 5D:
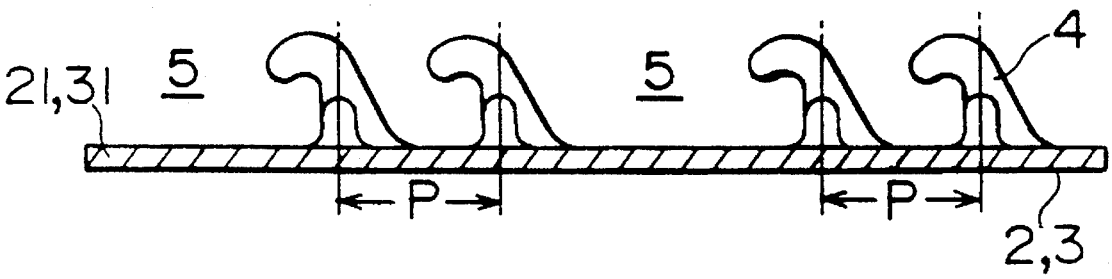

FIG. 4 shows an arrangement pattern of hook elements of a second embodiment of this invention. FIGS. 5(A), (B), (C) and (D) are side views showing every row of hook elements of the second embodiment.

According to this second embodiment, the arrangement of the hook elements 4 repeats the same patterns at every six rows A, D, B, D, C, D and the hook elements 4 of the D-rows are disposed always in the same pattern and with the hook being oriented in the same direction. The hook elements 4 of the other A, B, C-rows are arranged between the D-rows and oriented in the reverse direction relative to the D-rows. Two hook elements 4, 4 of three rows A, B, C are arranged as a whole at an obliquely figured textile. Of course, in this example, two hook elements 4, 4 of predetermined pitches respectively and a spacing 5 of two pitch lengths are repeatedly arranged in order as stated above.

When two engaging members of the above-mentioned structure are used as upper and lower surface fastener 1, it is possible to assure reliable engaging strength as well as the above-mentioned first embodiment and further to provide easy engaging and discoupling of the surface fastener. As stated hereinabove, in accordance with this invention, advantageous results can be obtained as follows.

Since a pair of engaging members of surface fasteners have the same structures of integrally molded article, it is possible to assure high engaging strength and sufficient durability for repeated use, to promote high manufacturing efficiency, and to provide easy controlling and attaching work in the stock and the shipment. Since the hook elements are rationally arranged on the engaging members, the surface fastener can be uniformly engaged with each other to provide uniform strength throughout the surfaces.

Since the hook element has a specific shape of a generally wavy cross section and the hook elements of the first and second engaging members are oriented in the reverse directions relative to each other, the engaging and disengaging operation of the surface fastener can be smoothly carried out without damaging the hook elements.

Accordingly, the surface fastener of this invention may be widely used in various fields and especially in the industrial material field which requires strong and uniform engagement.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A surface fastener molded integrally of synthetic resin, the surface fastener comprising:

a pair of upper and lower engaging members respectively molded integrally and provided with a plurality of rows of hook elements on engaging base plates, each of said hook elements having a raised portion having a back face extending with a gentle slope from said engaging base plate and a front face, and a hook-like engaging portion extending from the end of said raised portion forwardly, wherein two hook elements and a spacing which occupies a length of twice as much of a pitch of said two hook elements without hook elements are successively arranged in order in every row on each engaging member, and adjacent rows of hook elements are mutually shifted by predetermined pitches.

2. The surface fastener molded integrally of synthetic resin according to claim 1 wherein adjacent rows of hook elements of each engaging member are oriented in mutually opposite directions.

3. The surface fastener molded integrally of synthetic resin according to claim 1 wherein the sectional area of said hook element is increased gradually from the tip end of said hook-like engaging portion to the root of said raised portion.

* * * * *